US007118474B2

(12) United States Patent
Bjordal

(10) Patent No.: US 7,118,474 B2
(45) Date of Patent: Oct. 10, 2006

(54) ARRANGEMENT FOR CONTROLLING AIRFLOW FOR EXAMPLE IN CLEAN ROOMS

(76) Inventor: Oddvar Inge Bjordal, Sleiverudlia 30, Baerums Verk (NO)

( * ) Notice: Subject to any disclaimer, the term of this patent is extended or adjusted under 35 U.S.C. 154(b) by 182 days.

(21) Appl. No.: 10/479,708

(22) PCT Filed: Jun. 6, 2002

(86) PCT No.: PCT/NO02/00202

§ 371 (c)(1),
(2), (4) Date: Mar. 1, 2004

(87) PCT Pub. No.: WO02/099341

PCT Pub. Date: Dec. 12, 2002

(65) Prior Publication Data

US 2004/0137836 A1 Jul. 15, 2004

(30) Foreign Application Priority Data

Jun. 6, 2001 (NO) ..... 20012771

(51) Int. Cl.
*B01L 1/04* (2006.01)

(52) U.S. Cl. ..... 454/238; 454/187

(58) Field of Classification Search ..... 454/238, 454/239, 255, 256, 340, 187
See application file for complete search history.

(56) References Cited

U.S. PATENT DOCUMENTS

| | | | | |
|---|---|---|---|---|
| 2,928,330 | A * | 3/1960 | Brandi | 454/238 |
| 5,205,783 | A * | 4/1993 | Dieckert et al. | 454/238 |
| 5,538,471 | A * | 7/1996 | Guiles, Jr. | 454/238 |
| 5,545,086 | A | 8/1996 | Sharp et al. | 454/238 |
| 6,186,891 | B1 | 2/2001 | D'Andrea | 454/187 |

* cited by examiner

*Primary Examiner*—Gregory Wilson
(74) *Attorney, Agent, or Firm*—Schneck & Schneck; Thomas Schneck

(57) ABSTRACT

A device for controlling airflow between a clean room (1) and an adjacent room (2) is described. Channels (10, 6) lead from the rooms (1, 2) to a common junction (8). A ventilation channel (9) is leading from the common junction (8) for feeding or carrying off air. In the channel (10) from the clean room (1) is included a resistor element for the airflow, while the channel (6) from the adjacent room (2) has low hydraulic impedance.

12 Claims, 3 Drawing Sheets

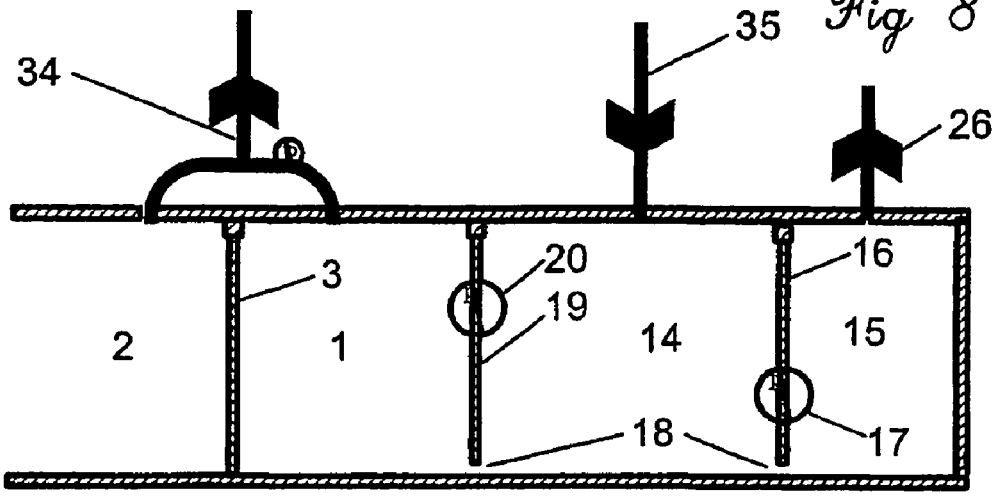
Fig 8
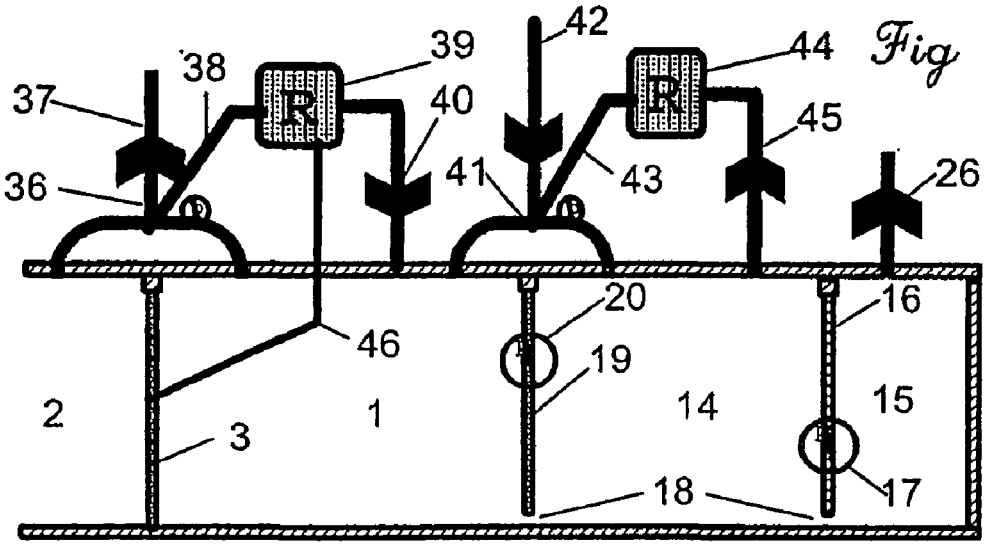
Fig 9
Fig 10
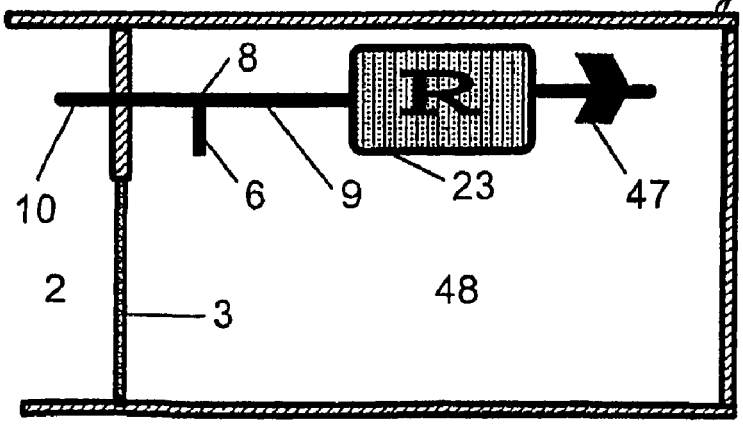

ARRANGEMENT FOR CONTROLLING AIRFLOW FOR EXAMPLE IN CLEAN ROOMS

FIELD OF THE INVENTION

The present invention relates to ventilation installations in buildings, where the building is divided into zones or rooms with differing air purities. In particular, the invention is applicable in the health sector, operating theatres, etc., and in the industry for clean rooms or in connection with particularly contaminated rooms. However, the invention is applicable in a number of other ventilation field where it is desirable to prevent or reduce the incorporation of air of particular content, or lack of particular content (pollen or other allergens, odours, dust, etc.), from one area to another, such as isolation wards and sterile rooms.

STATE OF THE ART

Fundamental for all forms of separation/isolation is separate rooms/cubicles/wards. With pollution entrained in the air, one tries to avoid air spreading from a polluted area to a cleaner one. Another general method is to dilute with clean air. The clean air can be fresh/treated air from outside, or air that has been purified before being sent back into the room.

All rooms, for people or animals, must be provided with fresh air (oxygen) and have spent air (air with waste from users and surroundings) removed. To prevent the required air-circulation from carrying contaminants from a polluted area into a clean area, cleaning and/or deactivating measures in the airflow from the most contaminated side are used. Such measures are, inter alia, filters, ultraviolet light and additives to the air flow, which shall deactivate or remove the contaminants. Such additives can in themselves cause problems if allowed to spread to the cleaner area. In practice, it is difficult to completely seal rooms. To prevent chance from deciding which way the air flows in such escapes, a higher pressure (excess pressure) is created on the cleanest side and lower pressure (sub-pressure) on the less clean side. This is made by regulating a difference between the amount of air supplied and removed. Such systems are described by, among others, CDC (Center of Disease Control and Prevention, Atlanta, Draft Guidelines for Environmental Infection Control in Healthcare Facilities, 2001). A problem in this situation is that air filters that are often used in the airflow from the polluted side become clogged and the amount of air decreases. Thereby, the intended difference in pressure and polluted air is reduced or even reversed, whereupon polluted air is forced into the cleaner zone. Countermeasures are more inspection and more frequent service. Control of small differences in pressure is difficult. Therefore, installations are constructed and set up with an "unnecessary" high degree of difference in pressure, in order to make sufficient simple control possible. Another approach is to make the control automatic and connect it to an automatic realignment of fan power in the ventilation system (U.S. Pat. No. 5,9512,394, U.S. Pat. No. 5,810,657). Tight isolates are more exposed to such pressure reversal than less tight isolates and sometimes demands of minimum leakage (CDC) are made. Another source of pressure reversal is failure in the part of the ventilation system (fan) that contributes to a functional difference in pressure, while the opposite port is intact. The ventilation system will in such situations contribute to effectively spread contaminated air. Therefore, expensive backup systems are built to take over in case of failure. All in all, the backup systems that shall secure the actual functions will contribute with a considerable share of the total costs. The reason for this is that current systems, in their basic function, without further security measures, have a limited functional security.

A person suffering from a critical airborne infection (for instance tuberculosis) is hospitalised in an isolation room with sub-pressure, and patients suffering from immunodeficiencies are placed in isolation rooms with excess pressure. If a immunocompromised patient is infected with an airborne infection, a need for both types of isolation will be present simultaneously. In practice, this is too expensive, and when considering whether to protect the patient or the surroundings, the patient loses and is placed in isolation with sub-pressure. The calculated minimum leakage then provides extra supply of polluted air, and is in such cases a disadvantage. Corresponding problems are also present in relation to surgery on infectious patients and other situations.

Access paths present a problem. A doorway is a rather large opening compared to other openings for air in connection with ventilation. Differences in pressure with closed doors disappears when doors are opened, and small thermal differences on each side of the doorway are enough for air to simultaneously flow in one direction in the upper section, and flow in the other direction in the lower section. Considering the large area represented by a door, this can amount to considerable amounts of air. Therefore, it is recommended that the traffic is reduced to only what is absolutely necessary (CDC). Isolation of patients causes a conflict with the human need to have contact with others, and patients also have a need for care and treatment. In order to reduce dissemination of disease in access openings, extra rooms (sluices, transfer closets) are built in connection with the openings, having a door to the special room and to the surroundings/common area. These doors are favourably arranged such that they cannot be opened simultaneously. This reduces the communication of contamination by first reducing the transfer to the amount that is mixed in the sluice from the contaminated zone and then again to the amount of air in the sluice that escapes to the common areas. Even minor differences in temperature between the rooms can contribute to this leakage becoming quite substantial. In an isolation ward with an airborne-infectious patient (sub-pressure), such spreading of contamination will lead the infection directly to central parts of the hospital. By waiting in the sluice, the content of the infection can be diluted, but often there are limited amounts of air accessible, so it takes a long time to attain practical dilution. Such a waiting period feels bothersome to the personnel (and is therefore ignored), and it is expensive to have personnel waiting.

In industry, small, clean rooms are supplied with a surplus of clean air. When moving in and out, industry has similar problems as to those of the health service.

In rooms with sub-pressure, a defined surplus of air is often drawn out. This can have fatal consequences in the case of fire and smoke, as smoke and gases from the corridor are drawn directly into the sub-pressure room.

SUMMARY OF THE INVENTION

A first objective of the invention is to obtain a device that in a simple and reliable manner can achieve high security for a suitable difference of pressure between rooms having different content in the air. This can be achieved even with a high degree of clogging of filters/channels or other forms of strong reduction in the function of the ventilation system. In a sub-pressure isolation room, for example, it would be possible to avoid excess pressure even if the ventilating fan stops and the supply air fan still functions. Even with a very simple/small back-up ventilating fan or local recycling arrangement, it would be possible to maintain a certain degree of sub-pressure.

Another object of the invention is to obtain a device that can arrange the air streams to shift to the doorways when the doors are opened. Thereby, a strong air flow is achieved in said doorways. The contaminated air can, by adjusting the doorway and amount of air, be hindered completely or to a greater degree, from entering the clean zone. In this way, good temperature neutralisation between air in the sluice and the other parts of special rooms is achieved, which contributes to reduce the pressure of infectious leakage.

A further object of the invention is to achieve a high number of air shifts in sluice systems connected to pressurised/sub-pressurised rooms. By doing so, a quick dilution of air pollution being sucked into or formed in the sluice can be achieved. This provides a lower degree of exchange of contamination and/or possibility of a quicker transition with the same degree of contamination exchange. The sluice itself gets the quality of quickly tending to a clean room. Thus, one is not dependent on allowing a certain degree of "uncontrolled" leakage in order to guard against pressure reversal. Thereby, an even higher degree of purity is achieved, as the supply can be cleansed to the degree of purity wanted.

Still another object of the invention is to provide a device that sees that a ventilation system to a lesser degree is influenced by incidental variation in pressure in corridors or other rooms that are connected to access roads. Doors opening and closing should neither influence the surroundings with regards to ventilation.

Still another object of the invention is to provide a device for simple control of a ventilation system, in order for the system to control itself within each local zone. A control of the total amount of added/removed air can take place in a common area where air balance normally is less critical than in a special room. Additionally, more systems bordering the same area are stabilised simultaneously. The individual excess pressure/sub-pressure systems are in a lesser degree dependent on the pressure conditions in the corridor/common room. Therefore, there is room to accommnondate the demands set by a central ventilation system and/or make other macroscopic appropriate solutions.

Still another object of the invention is to provide a device included in a ventilation system, so that the ventilation system completely or partially can react to the present local pressure condition and function independently of sensors, actuators and other parts of control loops, which easily fail.

Still another object of the invention is to provide a device in a ventilation system that combines sub-pressure and excess pressure so that pollution from the outside is prevented from entering an isolated zone, simultaneously with pollution from the inside being prevented from escaping.

Yet another object of the invention is to provide a device in a ventilation system with the ability to restrict smoke influx in sub-pressure rooms in the event of fire.

These objects are achieved in a device as stated in the appended patent claim 1. Further embodiments of the invention appear in the subsequent dependent claims.

BRIEF DESCRIPTION OF THE FIGURES

The invention will now be described with reference to the accompanying drawings, where:

FIG. 8 shows an excess pressure isolation room.

FIG. 9 shows a totally isolated room with both sub-pressure and excess pressure.

FIG. 10 shows a pressurized room based on a simple recycling generator.

DETAILED DESCRIPTION OF THE INVENTION

Figure 1:
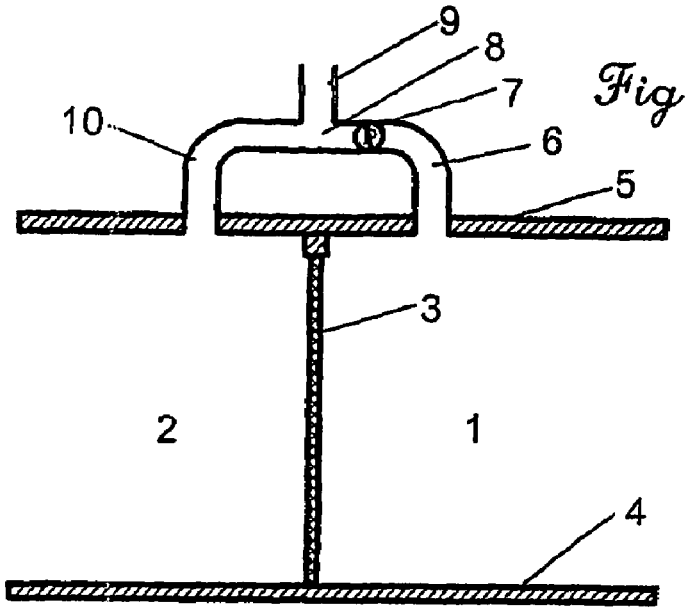
FIG. 1 illustrates an embodiment of the invention for supply/removal of air.

Initially, the invention will be discussed in terms of the sketch shown in FIG. 1.

The centre of the invention is a device or an arrangement with minimum three connected channels/flow paths where air can flow alternative routes depending on local pressure ratio in connected rooms/cells/zones. In at least one airflow route 6 is an arrangement that functions in such a manner that airflow in 6 gives a certain drop in pressure. Such an arrangement will hereafter be known as a resistor element. The resistor element, for example in 6, can be any device giving a difference in pressure by airflow, such as a restriction in area, a frame grate, a filter, a device influenced by flow and/or pressure ratio in or in connection to 6, a device influenced by conditions connected to door(s) between rooms with channels connected to the invention or a combination of two or more of said possibilities or equivalent. The design or dimension of the airflow route may also constitute or be included as a part in a resistor element. At least one airflow route 10 has low flow resistance/low hydraulic impedance (hereafter called low flow resistance). These airflow routes are hydraulically-connected at one end in a common room 8. The common junction can be a direct connection of airflow routes or a larger or smaller chamber/room. To this common junction is connected at least one additional airflow route 9 through which a certain amount of airflow is forced. The amount of air in the airflow route 9 can be fixed or dependent on conditions in or between associated rooms, in time and space. The airflow routes 6 and 10 extend from the common junction 8 to separate rooms, named 1 and 2. Room 1 is—or is a part of, a zone or system with special rooms, and the designation 1 can comprise this as a whole or only the room being connected to 6. 2 is a part of the surroundings/common area as a corridor or a neighbouring/adjacent room to 1. The access route between the rooms 1 and 2 is closable. In the room 1, except from what might pass through 6, is set up an appropriate imbalance in the amount of provided air and air carried away. The room 1 can be relatively tight and said imbalance in the amount of air flow will primarily pass through a resistor element in the airflow route and there bring about a differential pressure between the room 1 and the common junction 8. Even if the room 1 is less tight, a sufficient amount of air will pass via the resistor element in the airflow route 6, until a favourable differential pressure between the room 1 and the common junction 8. Because of the low hydraulic impedance in the airflow route 10, the difference in pressure over the resistor element in the airflow route 6 will practically be equal to the difference in pressure between the rooms 1 and 2, independent of the amount of airflow in the airflow route 10. If the resistor element is the type where pressure changes relatively little if the amount of air in the airflow route 6 varies, perhaps within a certain range of quantity, the difference in pressure between the rooms 1 and 2 will change little even if the relative degree of tightness of 1 is not exactly small.

The airflows to or from the common junction 8 are, in total, equal to 0. As the airflow in the airflow route 9 is stronger than the airflow in airflow route 6, with a closed door, one can secure either that supplied air having the quality in 9, or by collecting all air flowing through 6. Upon free passage (open door(s)) between the rooms 1 and 2, the difference in pressure between 1 and 2 drops till near zero, because of the very low hydraulic impedance represented by an open door. Furthermore, because of the very low hydraulic impedance between the room 2 and the common junction 8, all or a certain amount of the airflow that went through airflow route 6 when the door was closed, now must pass through the doorway and airflow route 10. In the following, the term resistance channel will be used on airflow route 6, the term reference channel on airflow route 10 and the term ventilation channel on airflow route 9. 1 is called special volume and 2 reference volume.

Net airflow through the doorway contributes to air flowing from clean to polluted zone, so that the amount of air flowing the opposite way is reduced or even becomes equal to zero. In order to strengthen the effect/provide even better margins; a limited doorway can be used for traffic which does not demand a completely open doorway. Alternatively and/or in addition, a system can be arranged to increase the total amount of airflow so that the mean airflow density/speed through the doorway becomes higher than it otherwise would have been.

The airflow in the ventilation channel 9 can be from a part of a central ventilation system, a separate ventilation system that collects/delivers air outside the building/construction, air that is collected/delivered within the building/construction (recycled) or a combination of the above mentioned. Air that is recycled so that it is brought from a polluted area to a cleaner area must be adequately cleansed/inactivated. Said air can also undergo other forms of air treatment, i.e. heating, cooling and/or regulation of humidity, ionization, neutralization, scenting, etc.

In connection with rooms/zones, a plurality of devices for ventilation can be present, which all work simultaneously and parts of devices can be shared between several rooms/zones. Variants are to establish connections 6, 6', 6", . . . from junction 8 to the same room or to several rooms 1,1', 1", . . . with access route to corresponding common room 2 or 2,2', 2", . . . , with their connections 10, 10', 2", . . . , and where predetermined amounts of air are supplied or carried off in 9 or 9,9', 9", . . . In a practical embodiment, there might be any number of said components: 6,1,10,2,9, including one and above.

Examples of means used to achieve a total system, can be developed from an example with a sub-pressure isolation room consisting of a sluice accessible from a corridor, a patient room accessible from the sluice and a bathroom accessible from the patient room. Basically, all vents are placed in the bathroom and air is provided in an outer device according to the invention above (the outer) door between the corridor and sluice (6 leads to sluice and 10 to corridor). With closed doors (access roads), the air passes overflow vents or specific resistor elements so that the air pressure gradually falls from room to room in the isolate. The opening of doors generates a net airflow through the doorways, said net airflow being equal for all doors except for changes that might be caused by air leakages. The amount of air in question can be the amount of fresh air needed to renew the air to be breathed. Often it might be desirable to increase the amount of air to get more net airflow through the doorway and/or achieve a quicker dilution of the air contaminants produced in the isolation ward. Then the amount of fresh air passing through the isolation ward can be increased. However, this often results in extra expenses for air treatment or it requires heavy investments and considerable space for installing channels. Then purified air being recycled locally can be used. The recycling function can be practised for a larger or smaller part of the isolation ward. Often, it is practical to avoid recycling air from bathrooms/toilet because of smell. Air is then often extracted from the patient room, treated and returned to the patient room or to another place further away. By recycling air to ventilation channel 9 in the outer device, an increased inwards airflow will arise by opening of the two outermost doors and simultaneous quicker dilution of air contaminants in both the sluice and in patient room(s). If there is too much airflow in the sluice when doors are closed, according to the invention the recycled air can be brought, in an inner device above the door, between the sluice and patient room(s). Compared to this device, the sluice corresponds to reference volume 2 and the patient room to special volume 1. The inner device can have an overflow device in parallel, between 1 and 2. By regulating/dimensioning of this overflow device, the amount of air desired to pass through the sluice while the door is closed can be regulated/dimensioned.

In reference channel 10, in the outer device, a fire damper can be placed. In case of fire or smoke/gas in the reference volume 2, this fire damper can be closed. Thus, an excess pressure in the sluice arises and smoke/gas/heat is hindered from being sucked up into the isolation ward, with the consequences that might entail.

By dimensioning the inner device to amounts of air giving full isolation to airborne infections, even with the door between the sluice and patient room open, the infection leakage from the patient room is independent from the pressure in the sluice. Further, by reversing the airflow in the outer device and supply the air from the outer device to the sluice, the sluice is turned into an excess pressure/clean room. As all leakages from the patient room are sealed, a complete isolation ward that does not leak airborne infections from the patient room and simultaneously does not import contaminated air from the outside is achieved. A corresponding arrangement would be suitable for operating theatres, etc., for patients suffering from airborne infections.

In principle, clean rooms have the same division between clean and infected zones. Required air directions and differences in pressure are only reversed compared to infection isolates.

FIG. 1 illustrates an embodiment of a device comprised by the invention. 1 is the room that is to be ventilated (the special volume). 2 is the surroundings or an adjacent room serving as reference (the reference volume) for the pressure in the special volume 1. Between the special volume 1 and the reference volume 2 is a door 3. 4 is the floor and 5 are the ceilings in the rooms. 1 is being ventilated causing an imbalance in the amount of air provided or removed. As the special volume 1 is relatively closed when the door is shut, the amount of air that, from the other ventilation in the special volume 1 is imbalanced, is forced through the channel 6 (resistor channel). Because of the channel's design/dimension or a particular resistor element 7, a difference in pressure between the special volume 1 and the common junction 8 arises. The amount: of air passing through the resistance channel 6 will further pass through the channel 9 (the shaft) and/or the channel 10 (the reference channel). The amount of air in the shaft 9 can be adjusted to an appropriate amount. The amount of air in the reference channel 10 will, dependent on the amounts of air passing through the shaft 9 and the resistance channel 6, be 0 or only a part of the air passing through the shaft 9. Because of low hydraulic impedance between the common junction 8 and the reference volume 2, these will be on approximately equal level of pressure even if the airflow in the reference channel 10 is changed. When the door 3 is opened, the hydraulic impedance from the special volume 1 to the common junction 8, via the doorway and the reference channel 10, becomes low and the air will pass through the doorway instead of through the resistor channel 6. In cases where opening of a door only leads to a reduction of the amount of air in the resistor channel 6 is also a variant of the invention.

Figure 2:
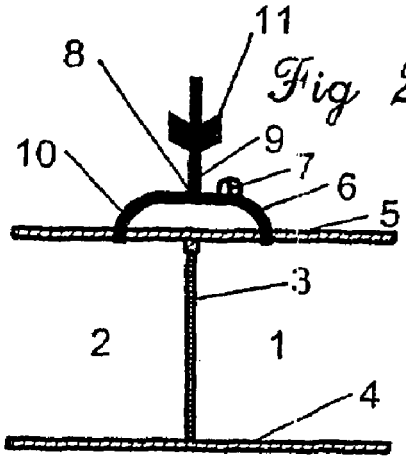
FIG. 2 is a sketch of the invention for removal of air.
Figure 3:
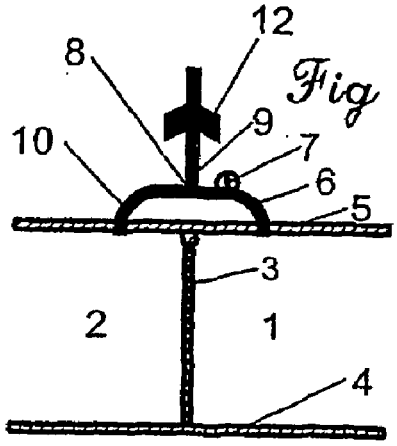
FIG. 3 is a sketch of the invention for supplying air.
Figure 4:
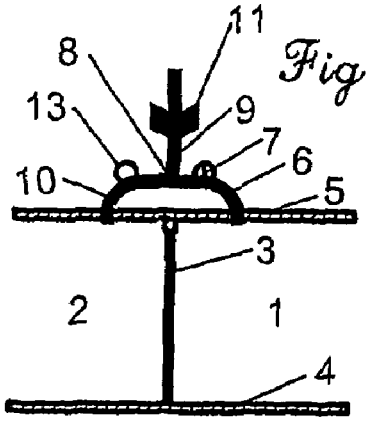
FIG. 4 is a sketch of the invention with a fire damper.

FIGS. 2 and 3 are schematic sketches of FIG. 1 with designation of the flow direction for air in the shaft 9. 11 illustrates that air is supplied in the device and 12 illustrates that air is removed (drawn out). FIG. 4 shows the placement of fire damper 12 in the reference channel. An amount of air larger than that which normally passes through the resistor channel 6 is fed into the shaft 9. The surplus passes through the reference channel 10 and out in the reference volume 2. In case of fire and the fire damper 13 closes, all air from the shaft 9 will be forced through the resistor channel and into the special volume 1 where an excess pressure arises. The excess pressure prevents the influx of fire-related gases.

Figure 5:
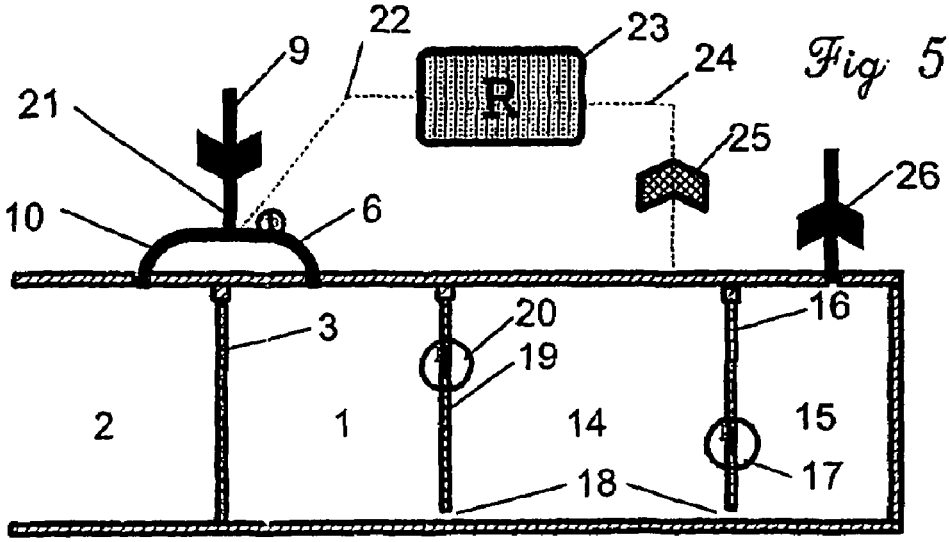
FIG. 5 is a sketch of the invention employed in a sub-pressure isolation room with sluice patient room and bath room with implied possibility to increase the amount of recycled air.

FIG. 5 shows the invention used in a sub-pressure isolation room with door 3 leading to a corridor 2. Reference numeral 1 is a sluice, 14 is a patient room and 15 an inner room as bathroom/toilet/decontamination room etc. Air is carried off from the isolation ward with the ventilator 26. Except for special overflow/resistor element 17, 20 or cracks by doors 18, the isolation ward is relatively airtight. The overflow/resistor elements 17, 20 are for simplicity shown in doors 16, 19, but can just as well be placed in any other barrier between the rooms in question, such as walls. Air that is drawn out by the ventilator 26 creates a sub-pressure in the room 15 that draws air from the patient room 14 via cracks 18 and/or resistor element/overflow device 20 from the sluice 1 and creates sub-pressure there. Finally, air is drawn off into the sluice via the resistor channel 6 in the device 21 that takes air from the shaft 9. When air passes a resistor element, a differential pressure is created so that a gradual dropping pressure extends into the isolation ward. The differential pressure is, among others, dependent on the amount of air flowing through the different resistor elements. If the ventilation 26 is reduced or fails completely, the sub-pressure is reduced and in case of failure, the sub-pressure disappears. However, excess pressure in the isolation ward does not occur as air that is blown into the shaft 9 escapes through the reference channel 10. Thermal imbalance can cause some local deviations in what is described when the differences in pressure are close to zero. When a door is opened, the difference in pressure drops to close to zero and the air is drawn through the doorway instead. Higher mean air speed is an important element to hinder contamination from passing from the contaminated side to the clean side. In order to achieve this, it is desirable to have plenty of air available. It is also desirable with lots of air to achieve a rapid replacement of air or a good reserve to create the desired sub-pressure. In FIG. 5, a possible way to increase the amounts of air in the isolation ward is marked with a broken line. With a recycling generator 23, the amounts of air can be increased without increasing the demand for the amount of air in the ventilator 26 and/or the shaft 9. The recycling apparatus can be used simply as a reinforcement of the existing ventilation. As there might be problems with smell in room 15 (e.g. toilet), air is drawn to the generator 23 from the patient room 14 with channel 24 and direction 25 as illustrated in FIG. 5. The generator itself contains the necessary means to lead and cleanse the air from the pollutants present. The generator can also include other forms of air treatment, heating, cooling or other. In the device 21, 9 and 22 occur as a combined shaft. Compared to the two outer doors, the isolation ward functions as before, and the only difference is that the amount of air is increased. In a constructionally sealed isolation ward, this is illustrated by that the amounts of air in the outer part, which used to be equal to the amount of air in 26, now equals the sum of the amounts of air in the channels 24 and 26.

Figure 6:
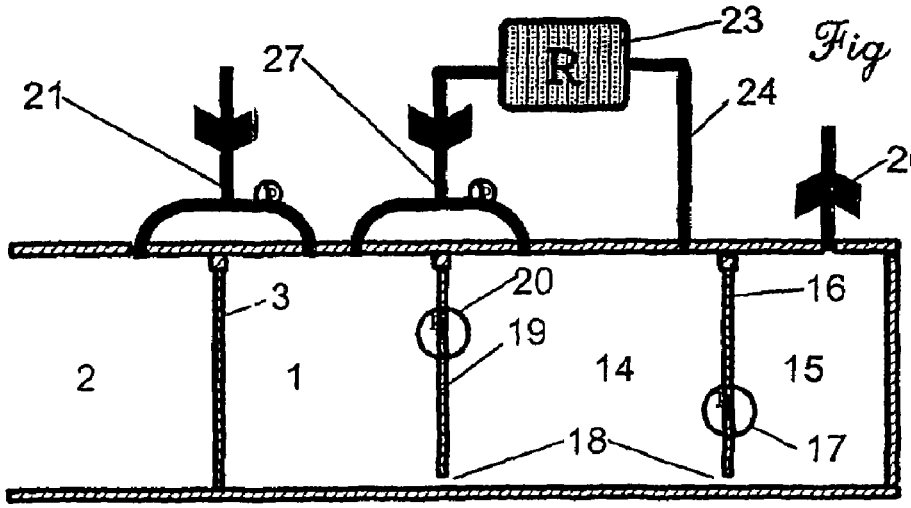
FIG. 6 illustrates two devices according to the invention in the same system.
Figure 7:
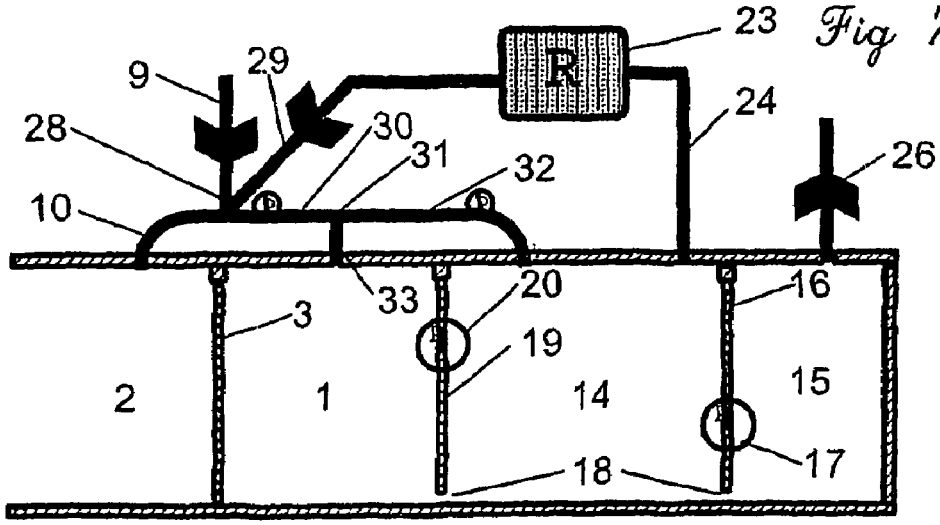
FIG. 7 shows compound devices.

FIG. 6 illustrates an alternative for the use of a recycling generator where the air from the generator 23 is fed to a separate device 27. Such an arrangement can be used when it is not desired to let large amounts of air through the sluice when the door between the sluice and the patient room is closed. The solutions in FIGS. 5 and 6 can be combined by letting air from the generator 23 spread to each of the devices 21, 27. Another possibility is illustrated in FIG. 7. Air 9 is here fed from a common ventilation system and air 29 from the recycling generator 23 to a common shaft in the outer device 28 with reference channel 10 and resistor channel 30. 30 is simultaneously the shaft of a device 31 with reference channel 33 and resistor channel 32. Here, the amount of air wanted through the sluice with closed doors can be determined, depending on set differences in pressure and leakage 18 between sluice 1 and patient room 14 and the resistor element 20. When doors are open, the total amount of air is available to create barriers to pollution in the open doors. In case of microbiological pollution, the channel systems can be equipped with ultraviolet lighting.

FIG. 8 shows an isolation room with excess pressure. Except for the room 15, the airflows are equal to the isolation room described in FIG. 5 (without the recycling arrangement), only with reversed directions of airflow and differences in pressure turned around. Again, it is not desirable to let air from rooms that may carry smell or other nuisances/hazards (15) spread to the other rooms. Air that the principles will be applicable just as well for any other room where there is a desire to isolate clean air from polluted air. Also, it would be natural to conclude from what is shown, how the principles can be used for more or fewer consecutive rooms.

FIG. 8 shows an excess pressure isolation ward. Except for the room 15, the airflows are similar to the isolation ward described in FIG. 5 (without the recycling arrangement) and with reversed directions of flows and differences in pressure. Again, it is not desirable to let air from rooms that can allow odour or other nuisances/hazards 15 to spread to the other rooms. Therefore, air 35 is fed to the patient room 14 and a smaller amount 26 is carried off from room 15. With an additional recycling generator, corresponding advantages are achieved, as stated for the sub-pressure isolation wards illustrated in FIGS. 5, 6 and 7, but for excess pressure isolation wards the direction of air is reversed so that air is fed to the patient room 14.

In FIG. 9, a combined sub-pressure and excess pressure system is shown. Such a system is suitable for immunocompromised patients suffering from airborne infections, operating theatres for patients suffering from airborne infections, etc. The patient room 14 and room 15 have subpressure compared to the sluice 1. The amounts of air that are drawn off by ventilators 25 and 26 can be so considerable that even with an open door, there will not be enough air that flows back from patient room to sluice. Thus, airborne infection is hindered from coming from the patient room. A prerequisite is that the air 26 is adequately cleansed. A generator of corresponding type as used for recycling can if necessary be used. Air 40 is fed to the sluice from the generator 39 and possibly from the reference channel in device 41, so that air is pressed out through the resistor channel in device 32. This provides the sluice 1 with an excess pressure compared to the corridor 2. In FIG. 9 is shown a possible connection 46 between the door 3 and the generator 39. Such a connection can consist of a possible change of amount of air in the generator 39 once the door 3 is opened. These and other connections are in principle possible for any generator or central parts of a ventilation system.

FIG. 10 illustrates a simple arrangement where a recycling generator 2, 3 and a device 8 with reference channel 10, resistor channel 6 and shaft 9 provides excess pressure in the room 48 by blowing in air 47. When the door/gate 3 is opened, air is drawn out through the doorway/gateway.

The invention is basically illustrated by examples for isolation wards, but any person skilled in the art will understand that the principles can be utilized just as well for other rooms where separation of clean air from polluted air is desired. Based on the illustrations, it should also be easy to conclude how the principles could be used for fewer or more consecutive rooms.

The invention claimed is:

1. A device for controlling airflow, for use in connection with ventilation of room/cell/zone, designated the special volume (1), having a degree of clean air different from surrounding/adjacent rooms, designated the reference volume (2), characterized in a system that is operated by air pressure alone including a minimum of three channels/channel systems (6, 9, 10) being hydraulically connected in a common junction (8), and in that air can be fed or carried off in at least one of the channels/channel systems, designated the ventilation channel (9), and that in at least one of the other channels/channel systems, designated the reference channel(s) (10), is a low hydraulic impedance from the common junction (8) to the reference volume (2) and that at least one of the other channels/channel systems (6) extends between the common junction and the special volume (1) and has a design or a device, designated the resistor element (7) which provides a suitable drop in pressure when air flows through and that between the reference volume (2) and the special volume (1) is a closable access path (3).

2. A device according to claim 1, characterized in that in the channel (9) for feeding/carrying off air, flows an amount of air greater than the amount of air flowing in the channel (6) between the common room (8) and the special volume (1).

3. A device according to claim 1, characterized in that except for the amount of air in the associated system, the air is either only fed or carried off in the special volume (1).

4. A device according to claim 1, characterized in that the special volume (1) consists of two or more rooms (14, 15) and that feeding/carrying off of air takes place in another room (15) than the room having a channel connection to the common junction and that between the rooms is/are, in addition to closable access path(s) (16, 19) are overflow/leakage/resistor elements (17, 18, 20) for air giving a suitable difference in pressure between the rooms (14, 15) at predefined amounts of air.

5. A device according to claim 4, characterized in that from the common junction is a corresponding channel connection to several independent special volumes (1, 14).

6. A device according to claim 4, characterized in that to a special volume (1, 14) with several access paths via separate room(s) in the special volume (1, 14) are channel connections, from the common room, arranged such that a difference in pressure arises when air flows to more than one of the rooms.

7. A device according to claim 1, characterized in that all or parts of the amount of air flowing through the ventilation channel is air being recycled, with additional cleansing, within the volumes concerned.

8. A device according to claim 1, characterized in that the device is arranged for feeding of air, and that in the reference channel (10) is inserted a damper that can be closed in case of fire, build-up of smoke, or if other air with particularly dangerous content is present in the surroundings or in the reference room.

9. A device according to claim 1, characterized in that the device is arranged for carrying off air, and that in the channel between the special volume (1) and the common junction (8) is inserted a damper that can be closed in case of fire, build-up of smoke, or if other air with particularly dangerous content is present in the surroundings or in the reference room.

10. A device according to claim 1, characterized in that ultraviolet light is used in the channels/channel systems.

11. System for controlling airflow in a ventilation system, characterized in that two or more devices according to claim 1 are associated with the same room in a special volume (1, 14).

12. System according to claim 11, characterized in that the common junction on a device is connected to the common junction in another device by means of a reference channel.

* * * * *